United States Patent [19]

Capps et al.

[11] 4,127,857

[45] Nov. 28, 1978

[54] RADIO FREQUENCY ANTENNA WITH COMBINED LENS AND POLARIZER

[75] Inventors: Charles P. Capps, Goleta; George S. Hardie, Santa Barbara; Arthur C. Ludwig, Santa Barbara; Michael J. Maybell, Santa Barbara; Gary A. Wideman, Goleta, all of Calif.

[73] Assignee: Raytheon Company, Lexington, Mass.

[21] Appl. No.: 801,974

[22] Filed: May 31, 1977

[51] Int. Cl.[2] ..... H01Q 19/06; H01Q 15/24

[52] U.S. Cl. ..... 343/754; 343/756; 343/854

[58] Field of Search ..... 343/754, 854, 756, 909, 343/911 R

[56] References Cited

U.S. PATENT DOCUMENTS 2,978,702 4/1961 Pakan ..... 343/773

3,754,270 8/1973 Thies ..... 343/754

*Primary Examiner*—Eli Lieberman

*Attorney, Agent, or Firm*—Richard M. Sharkansky; Joseph D. Pannone

[57] ABSTRACT

A multibeam antenna having a radio frequency lens fed by a plurality of feedports is disclosed. The radio frequency lens includes a printed circuit parallel plate region and a polarizer section. The polarizer section includes a plurality of polarizer sheets separated by a plurality of layers of dielectric material, the dielectric constant of the printed circuit parallel plate region and the dielectric constant of the layers of dielectric material being selected to form substantially collimated beams, each one of such beams being associated with a corresponding one of the feedports. With this arrangement, the polarizer section is an integral part of the radio frequency lens, thereby reducing the size of the antenna.

7 Claims, 5 Drawing Figures

FIG. 2
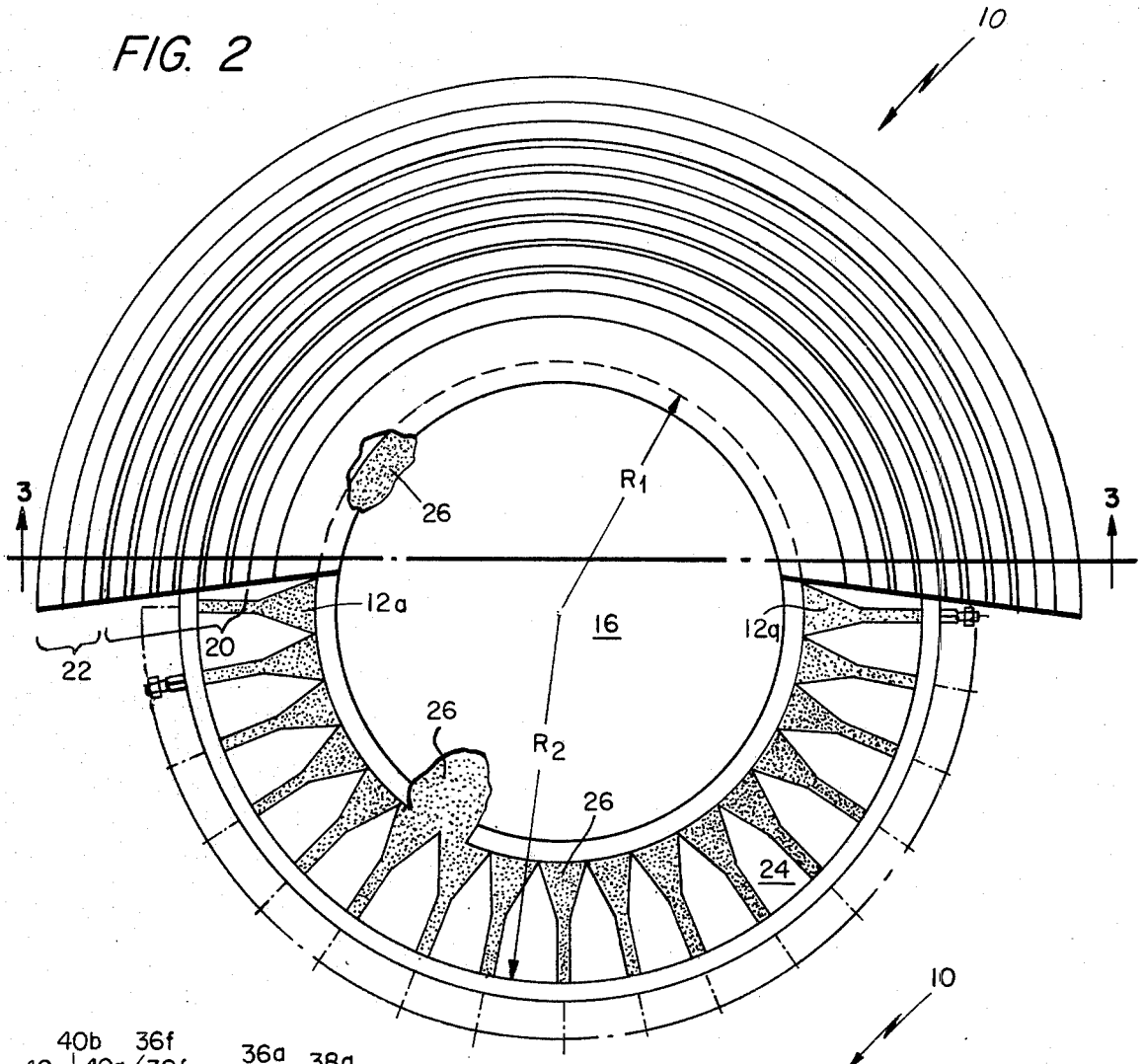
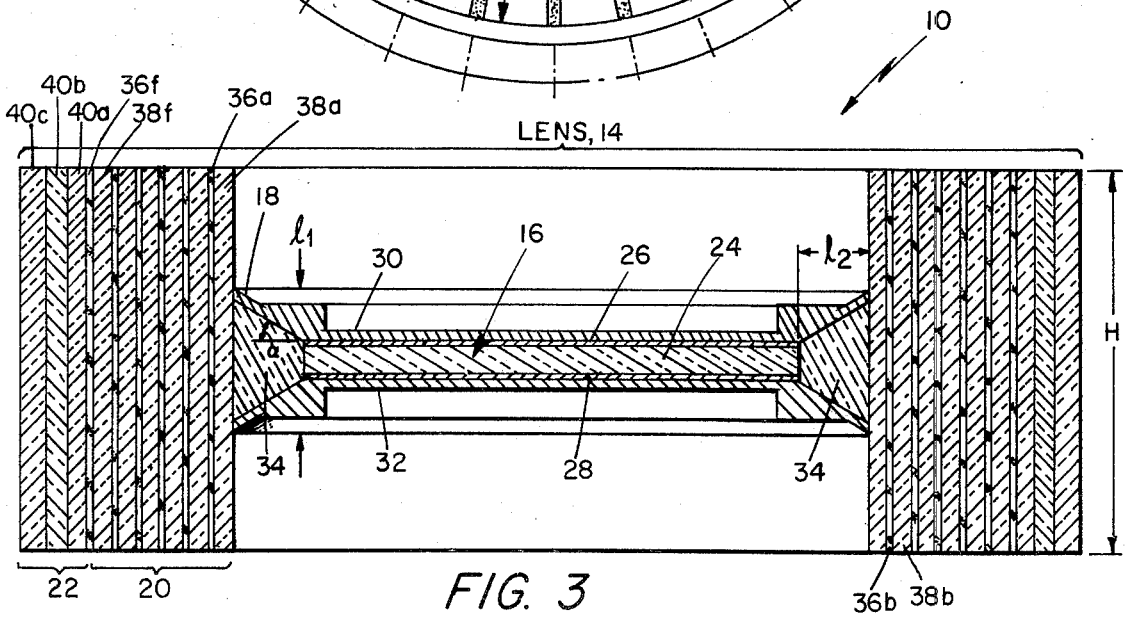
FIG. 3

FIG. 5
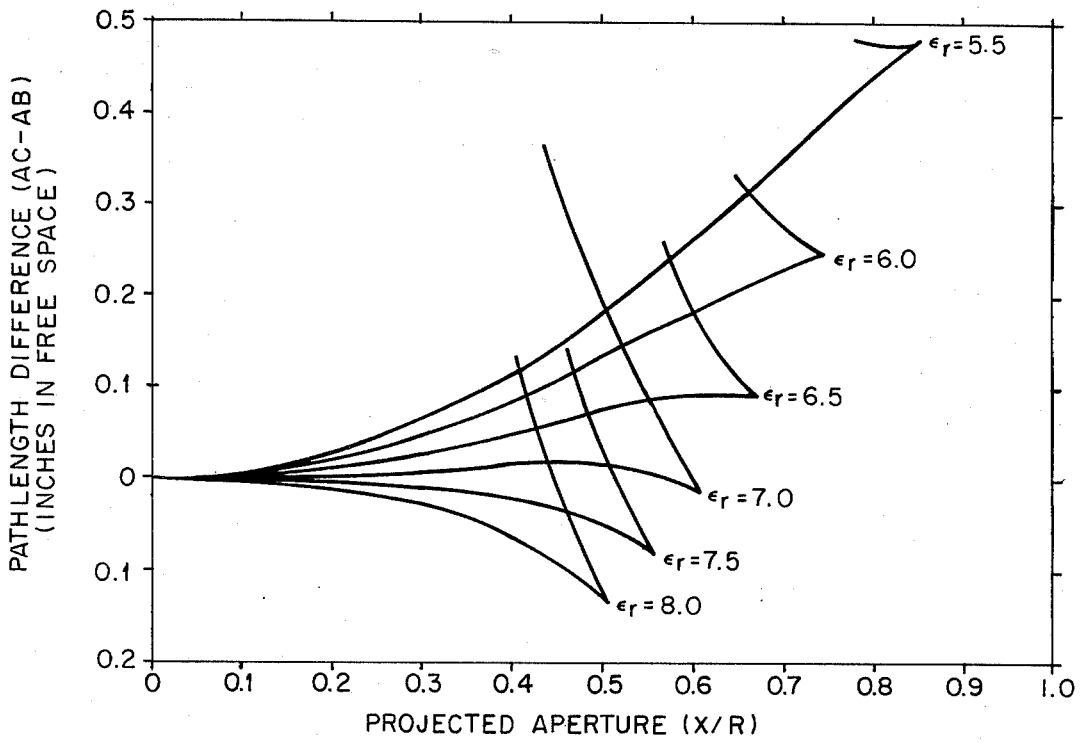
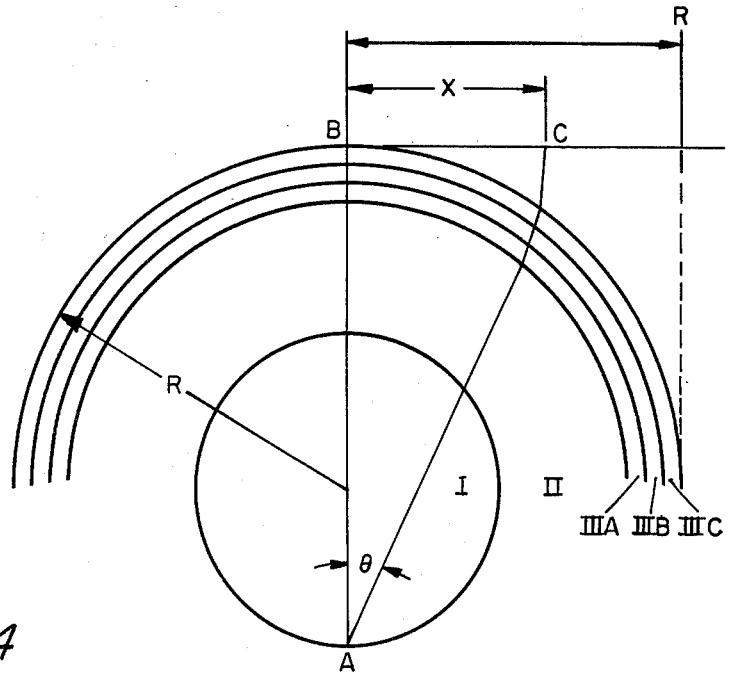
FIG. 4

RADIO FREQUENCY ANTENNA WITH COMBINED LENS AND POLARIZER

BACKGROUND OF THE INVENTION

This invention relates generally to radio frequency antennas and more particularly to multibeam antennas adapted to operate with radio frequency energy having circular polarization.

As is known in the art, an array of antenna elements may be fed through a parallel plate radio frequency lens in such a manner that one or more beams of radio frequency energy are formed. In one known antenna assembly of the type just mentioned and described in U.S. Pat. No. 3,761,936, issued Sept. 25, 1973, entitled "Multibeam Array Antenna," inventors Donald H. Archer, Robert J. Prickett and Curtis P. Hartwig, assigned to the same assignee as the present invention, a linear array of antenna elements, transmission lines, parallel plate radio frequency lens and plurality of feedports are formed on a common substrate using printed circuit techniques. The feedports of the parallel plate radio frequency lens are coupled to the array of antenna elements through different constrained electrical paths, such paths being the printed circuit transmission lines. In another known antenna, described in U.S. Pat. No. 3,754,270, issued Aug. 21, 1973, entitled "Omnidirectional Multibeam Array Antenna," inventor Wilbur H. Thies, Jr., assigned to the same assignee as the present invention, the antenna assembly includes a parallel plate radio frequency lens with feedports formed as printed circuits on a circular dielectric substrate. Antenna elements are coupled to the feedports through different constrained electrical paths, such as through coaxial cables. In either design, with the different constrained electrical paths properly adjusted, it is possible to create any desired number of collimated beams, each one of the beams having a different scan angle. In a copending patent application, Ser. No. 672,701, filed Apr. 1, 1976, inventor George S. Hardie, assigned to the same assignee as the present invention, a multibeam antenna of the type described above, which is useful in applications requiring reduced size, includes a printed circuit parallel plate region having a plurality of feed ports disposed about one portion of the outer periphery of the lens and a continuous, flared radiating structure disposed about a second portion of the parallel plate region, the radiating structure being coupled to the feedports through unconstrained electrical paths provided by the parallel plate region thereby producing substantially collimated beams without requiring different constrained electrical paths between individual antenna elements and the lens. While such antenna is useful in many applications, in applications where such antenna is to be used with radio frequency waves having arbitrary polarization, a separate polarizer is generally required in front of the radio frequency lens and the radiating structure, thereby increasing the size of the antenna.

SUMMARY OF THE INVENTION

With this background of the invention in mind, it is an object of this invention to provide an improved multibeam antenna adapted to transmit or receive radio frequency waves having an arbitrary polarization.

This and other objects of the invention are attained generally by providing a multibeam antenna, comprising: a radio frequency lens, fed by a plurality of feedports, such lens including a printed circuit parallel plate region, and a polarizer section. The polarizer section includes a plurality of polarizer sheets separated by a plurality of layers of dielectric material, the dielectric constant of the printed circuit parallel plate region and the dielectric constant of the layers of dielectric material being selected to form substantially collimated beams, each one of such beams being associated with a corresponding one of the feedports. In this way, the polarizer section is an integral part of the radio frequency lens, thereby reducing the size of the antenna.

BRIEF DESCRIPTION OF THE DRAWINGS

For a more complete understanding of the invention reference is now made to the following drawings wherein:

FIG. 2 is a plan view, partially broken away, of the multibeam shown in FIG. 1;

FIG. 3 is a cross-sectional elevation view of the multibeam antenna, such cross-section being taken along the line 3—3 of FIG. 2;

FIG. 4 is a diagram showing various regions of the multibeam antenna shown in FIG. 1; and FIG. 5 is a graph showing the relationship between path length difference and projected aperture for various dielectric constants used in region I shown in FIG. 4.

DESCRIPTION OF THE PREFERRED EMBODIMENT

Figure 1:
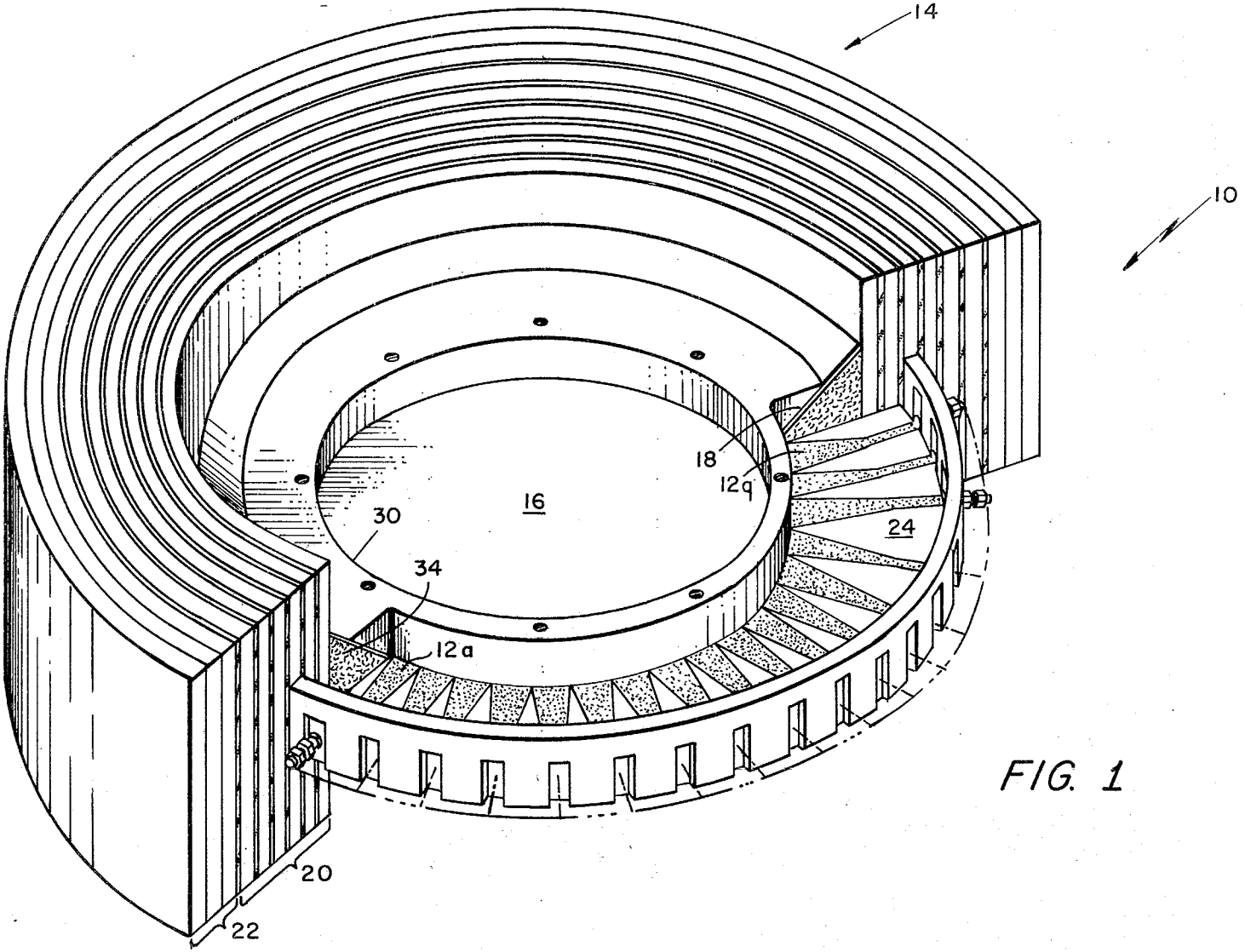
FIG. 1 is an isometric drawing of a multibeam antenna according to the invention.

Referring now to FIGS. 1, 2 and 3, a multibeam antenna 10 is shown to include a plurality of, here 17, feedports 12*a*–12*q* and a radio frequency lens 14 fed by such feedports 12*a*–12*q*. The radio frequency lens 14 includes a circular shaped, printed circuit parallel plate region 16, a polarizer section 20, and an impedance matching transformer section 22 to reduce reflections at the free space-antenna boundary and to match the impedance of the multibeam antenna 10 to free space. A flared transition section 18 is electrically coupled to the plurality of feedports 12*a*–12*q* through unconstrained electrical paths provided by the parallel plate region 16.

The printed circuit parallel plate region 16 and the feedports 12*a*–12*q* are formed on a dielectric substrate 24. One portion of such substrate 24 has an outer radius $R_1$, which here extends over an arc of 160°, and the remaining portion of such substrate has a greater outer radius, $R_2$, as shown. Conductive sheets 26, 28 are bonded to the faces of the substrate 24. Portions of the conductive sheet 26 are etched away, using any conventional process, to form feedports 12*a*–12*q* as microstrip circuits, the strip conductors of such circuits being provided by the triangular shaped regions in sheet 26 and the ground plane for such circuits being provided by the portion of the conductive sheet 28 which extends from the radius $R_1$ to the radius $R_2$. The feedports 12*a*–12*q* are coupled to coaxial connectors, not numbered, using any conventional technique, the center conductors of such connectors being connected to the apex of the triangular shaped center conductors of such microstrip circuits and the outer conductors of such connectors being connected to the ground plane, i.e., conductive sheet 28, of such microstrip circuits.

The flared transition section 18 includes a pair of metal plates 30, 32, here made of aluminum. Such plates are identical in shape and include a circular portion which is electrically and mechanically connected to the portions of the conductive sheets 26, 28 which form the outer conductors of the parallel plate region 16, here using a suitable conductive epoxy, such as a silver loaded epoxy. As shown in FIGS. 1 and 3, a portion of the outer periphery of such metal plates 30, 32 makes an acute angle $\alpha$, here 35°, with the circular portion of such metal plates 30, 32 so that when such metal plates are affixed to the outer conductors of the parallel plate region 16 (i.e., the portions of the conductive sheets having a radius $R_1$), a continuous, flared transition structure is formed. Here such flared transition structure extends over an arc less than 180° (here 160°) and is flared, here to a length $l_1 = 1.70$ inches. The flared transition section 18 has a truncated-triangular shaped cross section, such being truncated by a portion of the outer periphery of the parallel plate region 16 as shown in FIG. 3. That is, the flared transition structure 18 is coupled to one portion of the outer periphery of the parallel plate region 16, and the plurality of feedports 12*a*–12*q* are coupled to the other portion of the outer periphery of such region 16, such flared transition structure 18 being coupled to the plurality of feedports 12*a*–12*q* through unconstrained electrical paths provided by the parallel plate region 16. Further, as will be described, each one of the plurality of feedports 12*a*–12*q* is associated with a corresponding one of a plurality of wavefronts, or collimated beams of radio frequency energy. A wedge-shaped dielectric element 34, here having an altitude $l_2$ of 1.15 inches, is affixed within the flared transition structure, here using any suitable non-conductive epoxy for reasons to become apparent.

The polarizer section 20 includes a plurality, here six, of polarizer sheets 36*a*–36*f* and, here six, layers of dielectric material 38*a*–38*f* affixed together using a suitable non-conductive epoxy (not shown) to form a sandwich structure, such polarizer sheets 36*a*–36*f* being separated one from the other by the layers of dielectric material 38*a*–38*f*, as shown. The polarizer section 20 is fastened to the transition section 18 by using a suitable non-conductive epoxy between the dielectric element 34 and a layer of dielectric material 38*a*. The polarizer sheets 36*a*–36*f* are of any conventional design, here each one of such polarizer sheets 36*a*–36*f* includes a plurality of meanderline arrays arranged to convert circularly polarized radio frequency energy received by the antenna 10 to linearly polarized radio frequency waves having an electric field normal to the faces of the dielectric substrate 24 to establish in the parallel plate region 16 TEM mode waves. (It should be understood that, because of principles of reciprocity, TEM mode radio frequency waves fed into the parallel plate region 16 through one or more of the feedports 12*a*–12*q* will become converted by the polarizer section 20 to radiate from the antenna 10 as circularly polarized radio frequency waves.) It should be noted that, as shown in FIG. 3, the polarizer section 20 has a rectangular cross section, here 4.0 inches in height, H. Further, each of the layers 38*a*–38*f* of dielectric material has a relative dielectric constant of 4.0. Therefore, the polarizer section 20 has a relative dielectric constant of 4.0 as does dielectric element 34 and thus provides substantially total internal reflection at the dielectric to air boundary of the polarizer section 20 for radio frequency waves leaving the flared transition section 18. Thus, the axial ratio of the antenna 10 is not degraded by energy spilling over the polarizer sheets 36*a*–36*f* as would be the case if the relative dielectric constant of the polarizer section 20 were near unity. Additionally, the reflection coefficient for the totally reflected wave is substantially invariant with polarization resulting in polarization independent aperture illumination and phase velocity within the polarizer section 20, a condition which would not exist if the dielectric boundary were bounded by a conductor rather than air. The polarization independent aperture illumination leads to good axial ratio over the elevation beamwidth of the antenna, while the polarization independent phase velocity leads to good wide bandwidth performance. The impedance matching section 22 includes here three layers of dielectric elements, 40*a*, 40*b*, 40*c*, affixed together and to the polarizer sheet 36*f* using any suitable non-conductive epoxy. The dielectric constants of the dielectric elements 40*a*, 40*b*, 40*c* are here 3.03, 2.0 and 1.32, respectively.

Having selected the dielectric constants of layers 38*a*–38*f* of dielectric material and the dielectric constants of dielectric elements 40*a*, 40*b*, 40*c*, polarizer section 20, and element 34, the dielectric constant of the dielectric substrate 24 is selected in a manner which provides collimated beams, i.e., minimizes the phase error between two points on a hypothetically linear wavefront. That is, referring also to FIG. 4, the dielectric constant of the dielectric substrate 24 is selected to provide minimum difference in the electrical length of path AB and path AC over the largest projected aperture, X/R. In such FIG. 4, the region I represents the dielectric substrate 24. The region II represents the layers of dielectric material 38*a*–38*f* and the dielectric element 34 in the polarizer section 20 (i.e., here each having a dielectric constant 4.0), and regions III*a*, III*b*, III*c* represent the dielectric elements 40*a*, 40*b*, 40*c*, respectively.

Referring also to FIG. 5, the relationship between the pathlength difference (AC − AB), in inches of free space, and the projected aperture X/R is shown for various dielectric constants $\epsilon_R$ in region I. Such relationship was derived where the radius of region I is 2.97 inches, the radius of region II is 5.69 inches, and the radius of regions III*a*, III*b*, and III*c* are 6.04 inches, 6.47 inches and 7.00 inches, respectively. From such relationship a dielectric constant of $\epsilon_R = 7.0$ for the dielectric substrate 24 (i.e., region I) provides the best focus (i.e., best collimation). However, it has been discovered that such dielectric constant does not necessarily provide optimum antenna gain because dielectric constants less than 7.0 for region I increase the length of the projected aperture X/R even though there is a slight tendency to defocus the lens 14. Further, referring also to FIG. 4, for reasonable values of $\epsilon_R$ (i.e., those which provide reasonable focus, $\epsilon_R$ from 6.5 to 7.0) as $\theta$ is varied, the projected aperture X/R reaches a maximum value of 0.668. Here, in order to provide "best focus" and "maximum" projected aperture (X/R), the dielectric constant of the dielectric substrate 24 is 6.5.

From the above discussion, it should again be noted that the radio frequency lens 14 includes both the parallel plate region 16 and the polarizer section 20 and, therefore, the polarizer section 20 is an integral part of such lens 14.

Having described a preferred embodiment of this invention, it is now evident that other embodiments incorporating its concepts may be used. For example, the radius of the parallel plate region 16 and the polarizer section 20 may be other than that disclosed. The dielectric constants of the dielectric substrate 24 and of the layers 36*a*–36*f* of material may be changed. The number of polarized sheets may also be different from that described. It is felt, therefore, that this invention should not be restricted to its disclosed embodiment but rather should be limited only by the spirit and scope of the appended claims.

We claim:

1. A multibeam antenna having a combined lens and polarizer, comprising:
   (a) a plurality of feedports, each one being associated with a corresponding beam of radio frequency energy; and
   (b) a radio frequency lens coupled to such plurality of feedports for providing collimation to each one of such beams, such lens comprising:
      (i) a printed circuit parallel plate region having dielectric material, such region having disposed about a first portion of the periphery thereof the plurality of feedports;
      (ii) a polarizer section including a plurality of polarizer sheets interleaved with a plurality of layers of dielectric material, having a dielectric constant substantially greater than one, such polarizer section being disposed about a second portion of the periphery of the parallel plate region; and
      (iii) the dielectric material of the parallel plate region and the dielectric material of the polarizer section having related dielectric constants selected to enable the lens to form each beam as a substantially collimated beam of radio frequency energy.

2. The multibeam antenna recited in claim 1 including a continuous, flared transition section disposed about the second portion of the periphery of parallel plate region between such second portion of the periphery of the parallel plate region and the polarizer section, such polarizer section and continuous, flared transition section being coupled to the plurality of feedports through unconstrained electrical paths provided by the parallel plate region.

3. A multibeam antenna having a combined lens and polarizer, comprising:
   (a) a plurality of feedports; and
   (b) a radio frequency lens coupled to such plurality of feedports for providing collimation to each one of a plurality of beams, such lens comprising:
      (i) a printed circuit parallel plate region having a dielectric substrate; and
      (ii) a polarizer section including a plurality of polarizer sheets and a plurality of layers of dielectric material having a dielectric constant substantially greater than one, such plurality of feedports being disposed about a first portion of the periphery of the parallel plate region and the polarizer section being disposed about a second portion of such periphery, such polarizer section being coupled to the plurality of feedports through unconstrained electrical paths provided by the parallel plate region, the dielectric constant of the parallel plate region substrate and the dielectric constant of the layers of dielectric material being related to enable radiation of collimated beams of radio frequency energy.

4. A multibeam antenna having a combined lens and polarizer comprising:
   (a) a plurality of feedports;
   (b) a parallel plate region having a dielectric substrate and conductive sheets formed on opposite faces of such substrate; and
   (c) a polarizer section, coupled to the parallel plate region, having a plurality of polarizer sheets and a plurality of interleaved layers of dielectric material having a dielectric constant substantially greater than one, the dielectric constants of the dielectric substrate and the layers of dielectric material being related to enable the antenna to collimate radio frequency energy coupled through the antenna to any one or ones of the plurality of feedports.

5. The antenna recited in claim 4 wherein the polarizer section is unbounded by conductive material.

6. A multibeam antenna having an integral lens and polarizer comprising:
   (a) a plurality of feedports;
   (b) radio frequency lens means, coupled to the plurality of feedports and a radiating aperture of the antenna, for collimating radio frequency energy associated with each one of the feedports and a corresponding beam of radio frequency energy passing through the antenna, such means including:
      (ii) a polarizer section having a plurality of polarizer sheets interleaved with layers of dielectric material, such material having dielectric constant substantially greater than one; and wherein such feedports are disposed about one portion of the outer periphery of the parallel plate region and the polarizer section is disposed about another portion of the parallel plate region, the dielectric constant of the dielectric substrate and the dielectric constant of the layers of dielectric material being related to enable collimation of beams of radio frequency energy.

7. The antenna recited in claim 6 wherein the parallel plate region is circular in shape, the feedports being displaced from the center of such parallel plate region a length $R_1$, wherein the polarizer section has a first outer surface disposed adjacent to the parallel plate region and a second outer surface disposed adjacent to the antenna aperture, such second outer surface being displaced from the center of the parallel plate region a length $R_2$, where $R_2$ is greater than $R_1$ and wherein the dielectric constant of the dielectric substrate is different from the dielectric constant of the dielectric material of the polarizer section.

* * * * *